US005775186A

United States Patent [19]

Rahm

[11] Patent Number: 5,775,186

[45] Date of Patent: Jul. 7, 1998

[54] POWER SCREW DRIVER

[75] Inventor: Erik Roland Rahm, Väsby, Sweden

[73] Assignee: Atlas Copco Tools AB, Nacka, Sweden

[21] Appl. No.: 749,823

[22] Filed: Nov. 15, 1996

[30] Foreign Application Priority Data

Nov. 16, 1995 [SE] Sweden ..... 9504088

[51] Int. Cl.[6] ..... B25B 23/157

[52] U.S. Cl. ..... 81/474; 81/475; 192/56.54; 173/178

[58] Field of Search ..... 81/467, 469, 470, 81/472–476, 429; 192/56.33, 56.54; 173/176, 178

[56] References Cited

U.S. PATENT DOCUMENTS 3,934,629 1/1976 Boman .
5,201,374 4/1993 Rahm .

FOREIGN PATENT DOCUMENTS 0 411 483 2/1991 European Pat. Off. .
159 616 3/1983 Germany .

*Primary Examiner*—D. S. Meislin
*Attorney, Agent, or Firm*—Frishauf, Holtz, Goodman, Langer & Chick

[57] ABSTRACT

A power screw driver for tightening self-tapping screws comprises a housing (10), a rotation motor, an output shaft (12), a torque limiting release clutch (11) having torque transferring cam unit (17, 19) and a spring biassed thrust element (20) exerting an engagement force on the cam unit (17, 19) and yielding axially to a release position as a desired output torque is reached. A screw bed (32) engaging contact member (31) coupled is to an activation unit (42) and is arranged to be axially displaced via the activation unit (42) of the activation means (42) a lock means (36, 39) from a thrust element (20) locking position during the thread forming phase of the tightening process to a thrust element (20) unlocking position during the final pretensioning phase.

8 Claims, 1 Drawing Sheet

POWER SCREW DRIVER

BACKGROUND OF THE INVENTION

The invention relates to a power screw driver, and in particular to a power screw driver intended for tightening of self-tapping screws.

The problem to be solved by the invention relates to tightening of self-tapping screws at assembly of sheet metal parts, where the output torque required during the initial thread forming stage is higher than the desired final pretensioning torque. If the power tool were set to deliver a maximum output torque high enough for the thread forming stage, the pretensioning torque would in most cases be too high and result in a stripping of the threads just formed.

One way of solving this problem is to use a power screw driver having a torque limiting ratchet clutch which produces a pulsating output torque at the set release torque level. The required thread forming torque is accomplished by letting the screw driver work on the screw for a few seconds, whereby the dynamic forces of the pulsating output torque are effective in driving the screw through the thread forming phase. As the thread forming is completed, the screw is run down by a nonpulsing torque to be seated against the surface bed of the sheet element being assembled. Still, it is crucial, however, that the operator is careful and quick enough not to let the screw driver deliver too many torque impulses to the seated screw, because if it does there is a great risk that the threads just formed are stripped away.

Another way of solving the problem of how to accomplish a high thread forming torque and a safe final tightening at a lower torque is to employ a torque limiting release clutch with a depth responsive lock means for preventing a premature release. A power screw driver comprising such a means is described in U.S. Pat. No. 3,934,629. This previously known screw driver comprises two release clutches arranged in series, one of which is set to release at a desired final pretensioning torque, whereas the other is a safety clutch set to release in case of seizure of the screw during thread forming. A lock means responsive to an axial displacement of the output shaft in relation to a screw bed support sleeve is arranged to prevent release of the final torque clutch during the thread forming stage.

This known screw driver is complicated as regard design, not only because of the double clutch arrangement but also due to the axial movability of the output shaft.

It is the main object of the invention to provide a structurally simple power screw driver for self-tapping screws, which comprises a torque limiting release clutch for safely preventing thread stripping at the final pretensioning of the screw joint, and means for obtaining an increased output torque by preventing the release clutch from releasing during the preceding thread forming stage.

Other objects and advantages will appear from the following specification and claims.

A preferred embodiment of the invention is below described in detail with reference to the accompanying drawings.

On the drawings

BRIEF DESCRIPTION OF THE INVENTION

DETAILED DESCRIPTION

Figure 1:
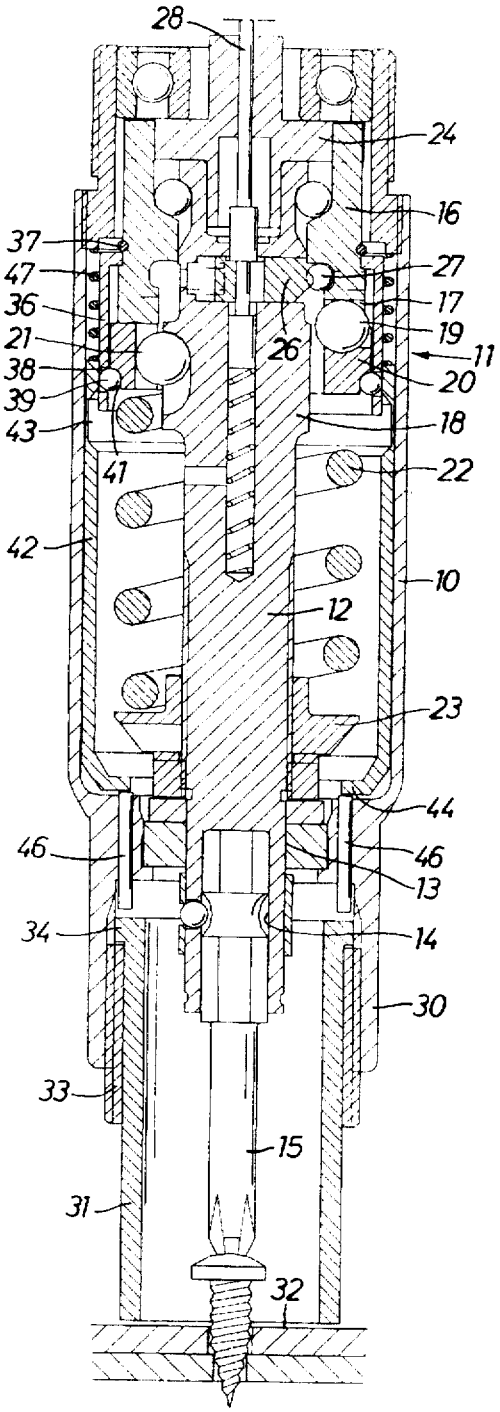
FIG. 1 shows a longitudinal section through the front section of a power screw driver according to the invention, illustrated in its thread forming condition.

The power screw driver shown in the drawing figures comprises a housing 10, a pneumatic rotation motor with a pressure air inlet valve (not shown), a torque limiting release clutch 11 and an output shaft 12. The latter is journalled at its forward end in a plain bearing 13 and is formed with a hexagonal socket portion 14 for receiving in a common way the hexagonal drive end of a screw driver bit 15.

The release clutch 11 is basically of the type described in U.S. Pat. No. 5,201,374 and comprises of a driving half 16 formed with axially directed cam surfaces 17, a driven clutch half 18 formed integral with the output shaft 12, a number of coupling balls 19 for cooperation with the cam surfaces 17, and an annular thrust element 20 rotationally locked to the driven clutch half 18 by a ball spline 21 and arranged to transfer an axial bias force from a compression spring 22 to the balls 19. The bias force of the spring 22 as well as the release torque level of the clutch 11 is adjustable by a movable support ring 23 threadedly engaging the output shaft 12. A drive spindle 24 transfers the driving torque from the motor to the driving clutch half 16 via a straight teeth clutch 25.

Associated with the release clutch 11 is a power shut-off mechanism coupled to the non-illustrated pressure air inlet valve. This shut-off mechanism is of the type previously described in the above mentioned U.S. Pat. No. 5,201,374, and since it does not form any part of the invention, it will not be described in great detail. Its main parts, however, are a latch plunger 26 transversely movable in a bore in the driven clutch half 18, a number of balls 27 located in pockets in the driving clutch half 16, and an activation rod 28 which is connected to the air inlet valve and is end-wise supported on the latch plunger 26 during tool operation. At relative rotation of the driving and driven clutch halves 16, 18, the balls 27 shift the latch plunger 16 to a position where the activation rod 28 is released and moved in a forward direction to, thereby, accomplish closure of the air inlet valve and shut-off of the motor. This is previously described in the above referred U.S. patent.

At its forward end, the housing 10 is formed with a neck portion 30 in which is displaceably guided a contact member in the form of a tubular sleeve 31. This sleeve 31 extends ahead of the screw driver bit 14 and is intended to get into contact with the work piece surface 32 forming the screw bed before the final tightening step starts. Forward movement of the contact sleeve 31 is limited by a sleeve element 33 threaded into the front end of the housing neck portion 30 and engaging a rear shoulder 34 on the contact sleeve 31.

The release clutch 11 is provided with a lock means which is coupled to the contact sleeve 31 and arranged to prevent the clutch 11 from releasing during the thread forming stage of the tightening process and to free the clutch 11 to release during the final tightening stage. This lock means comprises a thin-walled lock sleeve 36 secured to the driving clutch half 16 by means of a lock ring 37 and extending forwardly around the thrust element 20. The lock sleeve 36 is formed with circumferentially spaced radial apertures 38 each supporting a ball 39, and the thrust element 20 has an outer circumferential groove 41 for partly receiving the balls 39 in a thrust element locking position. The number of apertures 38 and balls 39 should be two or more for obtaining a balanced support of the thrust element 20.

On the outside of the lock sleeve 36, there is displaceably guided a shifting sleeve 42. Adjacent its rear end, the shifting sleeve 42 is formed with an inner circumferential groove 43 for partly receiving the balls 39 in a thrust element unlocking portion, and at its forward end the shifting sleeve 42 is formed with an inner annular flange 44 for engagement with a number of axially directed and longitudinally movable activation pins 46. The latters are supported in through bores in the housing 10 extending in parallel with the output shaft bearing 13. A spring 47 exerts a forward directed bias force on the shifting sleeve 42.

In operation, the tool is applied on a self-tapping screw by means of a screw driver bit 15, see FIG. 1, and the motor is supplied with motive pressure air via the air inlet valve which is maintained in open position by the activation rod 28 being supported on the latch plunger 26.

During the thread forming phase of the tightening process, the contact sleeve 31 is out of contact with the screw bed surface 32, which means that not only the contact sleeve 31 but also the pins 46 and the shifting sleeve 42 occupy their forwardmost positions under the bias of spring 47. See FIG. 1. This means in turn that the inner groove 43 of the shifting sleeve 42 is out of register with the balls 39 and that the balls 39 are positively maintained in their inner positions, thereby engaging the outer groove 41 on the thrust element 20.

In this position of the shifting sleeve 42, the thrust element 20 is axially locked in relation to the driving clutch half 16 via the balls 39 and the lock sleeve 36, and the coupling balls 19 which are in cooperation with the cam surfaces 17 are not able to displace the thrust element 20 to release the clutch 11. This means that the increased torque resistance during the thread forming tightening stage does not cause any release of the clutch 11.

Figure 2:
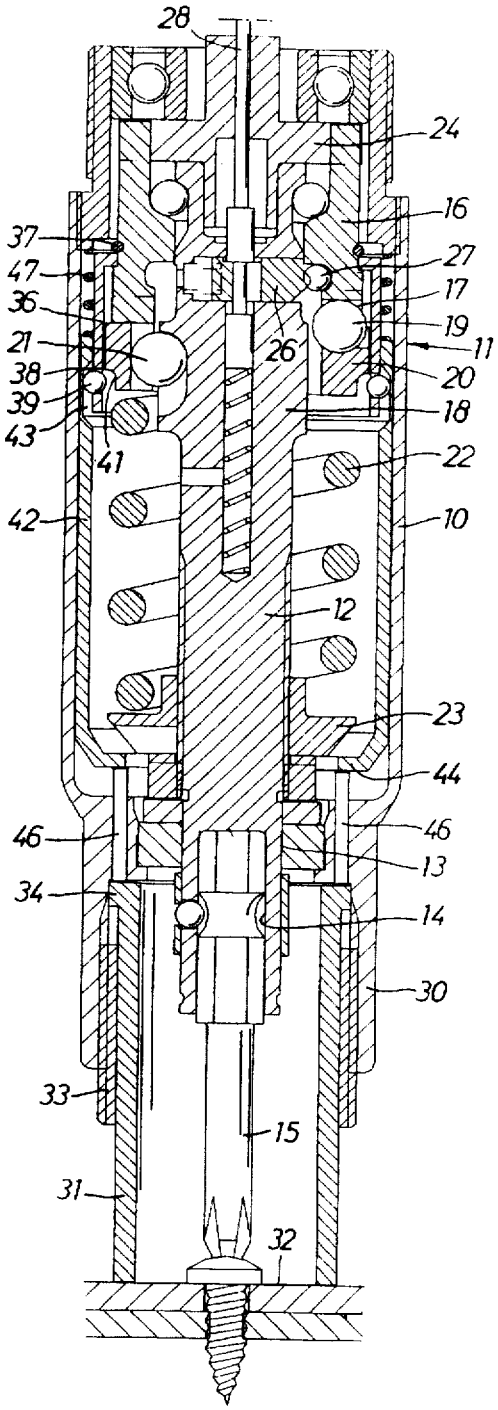
FIG. 2 shows the same section as in FIG. 1, but illustrates the screw driver in its final tightening condition.

As the head of the screw approaches the bed surface 32, the contact sleeve 31 lands on the surface and is displaced rearwardly in relation to the screw driver housing 10. This results in a successive rearward displacement of the pins 46 and the shifting sleeve 42, such that when the screw head lands on the bed surface 32 the inner groove 43 of the shifting sleeve 42 registers with the balls 39, thereby permitting the balls 39 to move outwardly and unlocking the thrust element 20 for axial displacement and release of the clutch 11. See FIG. 2. The final pretensioning of the screw may now be safely completed to the desired torque level where the clutch 11 releases and prevents overtightening.

As the clutch 11 releases, the relative rotation between the driving and driven clutch halves 16, 18 results in a displacement of the latch plunger 26 such that the activation rod 28 is allowed to move forwardly and accomplish a shut-off of the motive air supply to the motor.

At completed tightening, the screw driver is lifted off the screw, whereby the spring 47 pushes the shifting sleeve 42, the pins 46 and the contact sleeve 31 to their forward positions The groove 43 of the shifting sleeve 42 is moved out of register with the balls 39, and the latters are reengaged with the groove 41, thereby locking the thrust sleeve 20 against axial displacement and preventing the clutch 11 from releasing during a nextcoming thread forming tightening phase.

I claim:

1. A power screw driver for tightening self-tapping screws, comprising:

a housing (10) having a forward end;

an output shaft (12);

a torque limiting release clutch (11) including a driving clutch half (16) arranged to receive a driving torque from a rotation motor, and a driven clutch half (18) coupled to said output shaft (12);

a torque transferring cam unit (17, 19) and a movable spring biassed thrust element (20) which exerts an engagement force on said cam unit (17, 19), said thrust element (20) being displaced into a release position of the release clutch (11) as a desired output torque is reached;

a screw bed (32) engaging contact member (31) supported at the forward end of the housing (10), said contact member (31) being displaceably guided relative to said housing (10) in the axial direction of said output shaft (12);

a lock unit (36, 39) disposed between one of said clutch halves (16, 18) and said thrust element (20), and being shiftable between a thrust element (20) locking position and a thrust element (20) unlocking position;

said lock unit (36, 39) comprising at least two balls (39) supported in apertures (38) in an axially immovable lock sleeve (36) surrounding said thrust element (20), said balls (39) being radially movable between inner thrust element (20) locking positions and outer thrust element (20) unlocking positions;

said thrust element (20) having an external circumferential groove (41) arranged for engagement by said balls (39) in their inner thrust element (20) locking positions; and an activation unit (42, 46) coupling said contact member (31) to said lock unit (36, 39) so as to accomplish shifting of said lock unit (36, 39) from said thrust element (20) locking position to said thrust element (20) unlocking position as said contact member (31) is displaced rearwardly relative to the housing (10) at contact of said contact member (31) with the screw bed (32) during a final stage of a screw tightening process;

said activation unit (42, 46) comprising a shifting sleeve (42) surrounding said lock sleeve (36) and being provided with an internal circumferential groove (43) which by a rearward displacement of said shifting sleeve (42) enables a radial movement of said balls (39) from their inner thrust element (20) locking positions to their outer thrust element (20) unlocking positions.

2. The power screw driver according to claim 1, further comprising a spring unit (47) arranged to exert an axial bias force on said shifting sleeve (42) in a direction toward said thrust element (20) locking position.

3. The power screw driver according to claim 2, wherein said contact member (31) comprises a tube element arranged coaxially with said output shaft (12).

4. The power screw driver according to claim 1, wherein said contact member (31) comprises a tube element located coaxially with said output shaft (12).

5. The power screw driver according to claim 4, further comprising at least two activation pins (46) mounted in said housing (10) for longitudinal displacement in a direction parallel but offset to said output shaft (12), to thereby transfer axial movement between said contact member (31) and said shifting sleeve (42).

6. The power screw driver according to claim 3, further comprising at least two activation pins (46) mounted in said housing (10) for longitudinal displacement in a direction parallel but offset to said output shaft (12), to thereby transfer axial movement between said contact member (31) and said shifting sleeve (42).

7. The power screw driver according to claim 2, further comprising at least two activation pins (46) mounted in said housing (10) for longitudinal displacement in a direction parallel but offset to said output shaft (12), to thereby transfer axial movement between said contact member (31) and said shifting sleeve (42).

8. The power screw driver according to claim 1, further comprising at least two activation pins (46) mounted in said housing (10) for longitudinal displacement in a direction parallel but offset to said output shaft (12), to thereby transfer axial movement between said contact member (31) and said shifting sleeve (42).

* * * * *

UNITED STATES PATENT AND TRADEMARK OFFICE

CERTIFICATE OF CORRECTION

PATENT NO. : 5,775,186
DATED : July 7, 1998
INVENTOR(S) : Erik Roland RAHM

It is certified that error appears in the above-identified patent and that said Letters Patent is hereby corrected as shown below:

In the Abstract, line 8, change "coupled is" to --is coupled--;

line 10, change "of the activation means (42)" to --so as to accomplish shifting of--; and change "lock means" to --lock unit--.

Signed and Sealed this
First Day of August, 2000

*Attest:*

*Attesting Officer*

Q. TODD DICKINSON

*Director of Patents and Trademarks*